United States Patent [19]

Locke et al.

[11] Patent Number: 4,803,780

[45] Date of Patent: Feb. 14, 1989

[54] ELECTRIC DRY SHAVER HAVING AN IMPROVED TRIMMER ARRANGEMENT

[75] Inventors: David R. Locke, Bridgeport; Aivars Miska, Stratford; Richard M. McCarthy, Bridgeport, all of Conn.

[73] Assignee: Remington Products, Inc., Bridgeport, Conn.

[21] Appl. No.: 908,330

[22] Filed: Sep. 17, 1986

[51] Int. Cl.[4] ..... B26B 19/10

[52] U.S. Cl. ..... 30/34.1; 30/41.6; 30/43.92

[58] Field of Search ..... 30/34.1, 43.92, 41.6, 30/43, 32

[56] References Cited

U.S. PATENT DOCUMENTS

| | | | |
|---|---|---|---|
| 2,215,099 | 9/1940 | Going | 30/34.1 X |
| 2,345,695 | 4/1944 | Andis | 30/34.1 |
| 4,085,503 | 4/1978 | Beck et al. | 30/34.1 |
| 4,233,733 | 11/1980 | Gallanis et al. | 30/43.92 |

FOREIGN PATENT DOCUMENTS

| | | | |
|---|---|---|---|
| 102560 | 9/1965 | Denmark | 30/43.92 |
| 2329616 | 11/1974 | Fed. Rep. of Germany | 30/43.92 |
| 2904300 | 8/1979 | Fed. Rep. of Germany | 30/43.92 |

*Primary Examiner*—Donald R. Schran
*Assistant Examiner*—Michael D. Folkerts

[57] ABSTRACT

An electric dry shaver is described having a long hair trimmer which includes an elongated cutter member having a generally U-shaped configuration and elongated comb member having a U-shaped cross sectional configuration. The comb member is assembled with the cutter member to provide a relatively compact and rigid assembly.

10 Claims, 2 Drawing Sheets

Fig. 1.
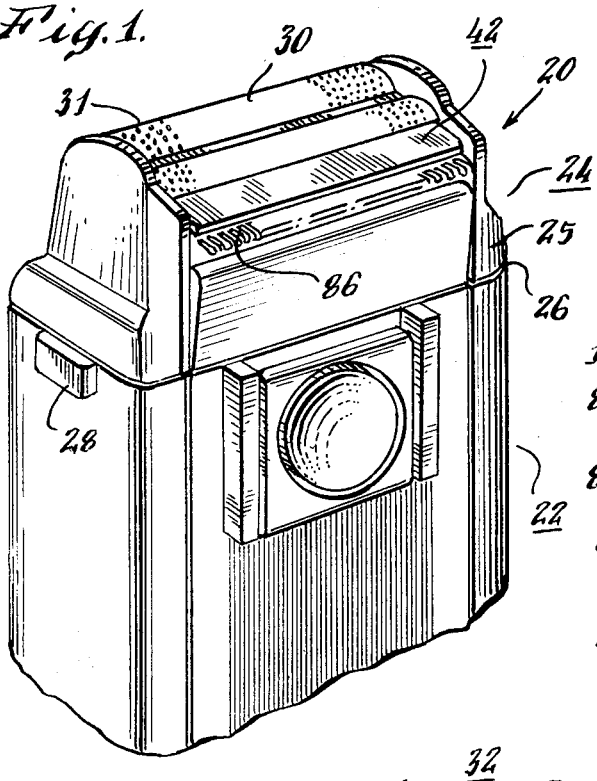
Fig. 2.
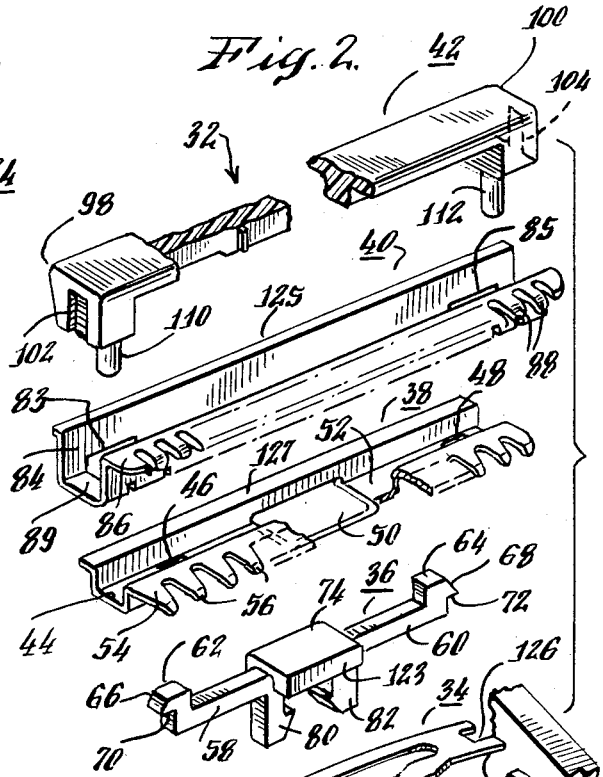
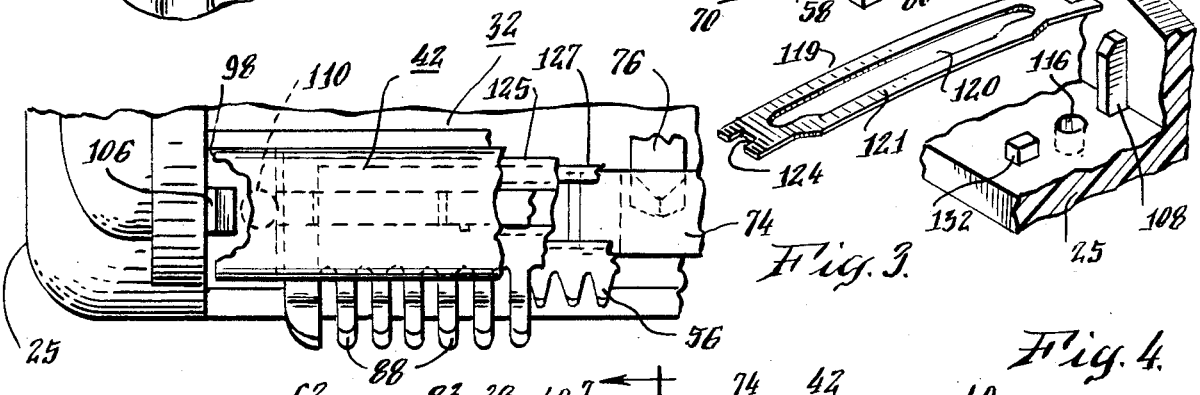
Fig. 3.
Fig. 4.
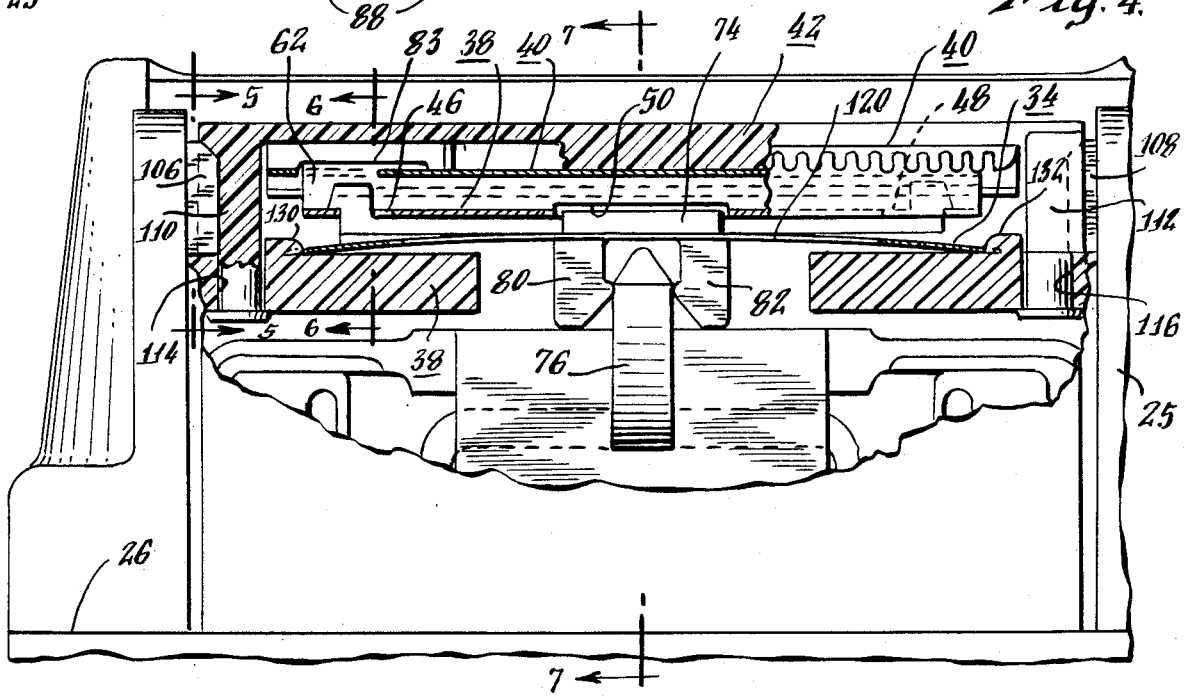

ELECTRIC DRY SHAVER HAVING AN IMPROVED TRIMMER ARRANGEMENT

BACKGROUND OF THE INVENTION

1. Field of the Invention

This invention relates to electric dry shavers and more particularly to an improved trimmer arrangement for an electric dry shaver.

2. Description of the Prior Art

Electric dry shavers are known which include a shaver head having a short hair cutter for shaving relatively short facial hairs and a hair trimmer for shearing relatively longer hairs. One known type is a foil shaver wherein the long and short hair trimmers are each positioned in a demountable hair pocket. The hair trimmer includes a stationary comb member and a moveable cutter member, each having a plurality of teeth. Reciprocating motion is established between the comb and cutter members and relatively longer body hairs which extend between the reciprocating teeth are sheared. An electric dry shaver of this type is disclosed in U.S. Pat. No. 4,089,109.

It is desirable that hair trimmers of the foregoing type assume a relatively compact configuration in order to facilitate handling and usage.

SUMMARY OF THE INVENTION

Accordingly, it is an object of this invention to provide an improved, compact hair trimmer arrangement for an electric dry shaver.

Another object of the invention is to provide a relatively compact hair trimmer arrangement with cutter and comb members having improved rigidity.

Another object of the invention is to provide a hair pocket for a foil type electric dry shaver having a relatively compact trimmer assembly mounted thereon.

A further object of the invention is to provide a relatively compact hair trimmer which facilitates fabrication and assembly.

Another object of the invention is to provide an improved electric dry shaver.

In accordance with features of the invention, an improved electric hair dry shaver includes a hand-held housing and a cutter head mounted at one end of the housing. The cutter head includes a short hair cutter and a relatively long hair trimmer arrangement. Included in the long hair trimmer arrangement is an assembly of an elongated comb member having a generally U-shaped cross sectional configuration and an elongated edge segment with a plurality of teeth formed therein. An elongated cutter member is also provided having a generally U-shaped cross sectional configuration and an elongated edge segment, also with a plurality of teeth formed in the edge segment. The U-shaped comb and cutter configurations each define elongated channels wherein the comb channel is partly positioned in the cutter channel along its length. The comb and cutter teeth are juxtapositioned for sliding engagement therebetween. A means is also provided for mounting the comb and trimmer to the cutter head. In a preferred embodiment, the cutter head includes a demountable hair pocket and the trimmer is mounted to the hair pocket. The electric dry shaver thus includes a hair trimmer which can be fabricated and assembled with relative ease and enhanced cost and provides a relatively rigid assembly thus enhancing the operating characteristics of the trimmer.

BRIEF DESCRIPTION OF THE DRAWINGS

These and other objects and features of the invention will become apparent with reference to the following specification and to the drawings wherein:

FIG. 1 is an enlarged, fragmentary, perspective view of the improved electric dry shaver of this invention;

FIG. 2 is an enlarged, perspective, exploded view of a hair trimmer assembly of this invention;

FIG. 3 is an enlarged, fragmentary, plan view of the electric dry shaver of this invention;

FIG. 4 is an enlarged, fragmentary, front elevation view, partly broken-away and partly in section of the hair trimmer of FIG. 1;

DETAILED DESCRIPTION

Figure 5:
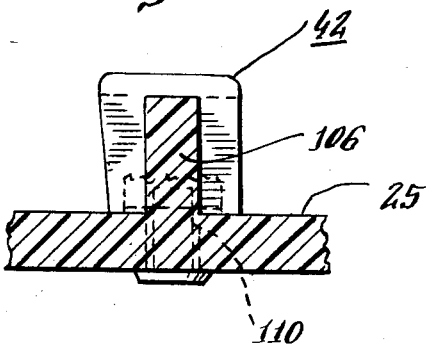
FIG. 5 is a view taken along Line 5—5 of FIG. 4.

Referring now to the drawings, an electric dry shaver 20 includes a hand-held housing 22 and cutter head 24 which includes a hair pocket 25 positioned at one end 26 of the housing. The hair pocket 25 is demountable from the housing by depressing a push button 28 which releases a captivating latch, not shown. The hair pocket 25 includes an apertured foil cutter member 30 which in cooperation with an inner assembly of cutter blades 29 (FIG. 7) forms a short hair cutter for cutting hairs which extends through apertures 31 in this member. This is a well known form of electric dry shaver arrangement and is shown for example in the aforementioned U.S. Pat. No. 4,089,109.

Also positioned on the hair pocket 25 is a trimmer assembly for cutting relatively longer hairs. The trimmer assembly, as illustrated in the exploded of FIG. 2, includes a spring bias member 34, a drive coupling member 36, a cutter member 38, a comb member 40 and a cover member 42. The cutter member 38 comprises an elongated metal body having a generally U-shaped cross sectional configuration which defines an elongated channel 44. First, second and third apertures 46, 48 and 50, respectively are formed in a surface 52 of this member. An elongated edge segment 54 of this member has a plurality of teeth 56 formed in the segment.

The coupling drive member 36 comprises a polymer plastic body having elongated arm segments 58 and 60, each having posts 62 and 64 respectively positioned at a distal location on the arm segment. The posts 62 and 64 each include tapered surfaces 66, 68 respectively which enable entry of the posts 62, 64 into the apertures 46, 48 respectively of the cutter member 38. These posts upon entering the apertures are captivated by engagement between lower surfaces 70, 72 of the posts 62 and 64, respectively and the surface 52 of the cutter member 38. The drive member 36 further includes a centrally located segment 74 which conforms in shape with the apertures 50 formed in the cutter member 38. The segment 74 extends into the aperture 50 to engage the member 38 and to impart motion of the member 38 upon motion of the drive member 36. Reciprocating motion is imparted to the drive member 36 by a segment 76 of an oscillator 78 (FIGS. 4 & 7) which engages depending leg segments 80 and 82 of the drive member 36.

The comb member 40 comprises an elongated body formed of metal and having a generally U-shaped configuration which defines an elongated channel 84. Apertures 83 and 85 are formed in a surface 89 of this member to provide clearance for and guide movement of the posts 62 and 64, respectively of drive member 36. An elongated edge segment 86 of the comb includes a plurality of teeth 88 formed therein. The edge segment 86 extends laterally for a distance greater than the edge segment 54 of the cutter member 38, as best seen in FIG. 4, and is flanged at its distal edge 90 (FIG. 7).

Figure 6:
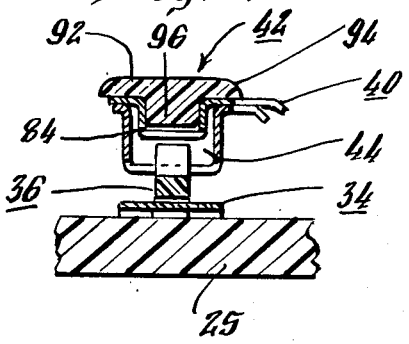
FIG. 6 is a view taken along Line 6—6 of FIG. 4.
Figure 7:
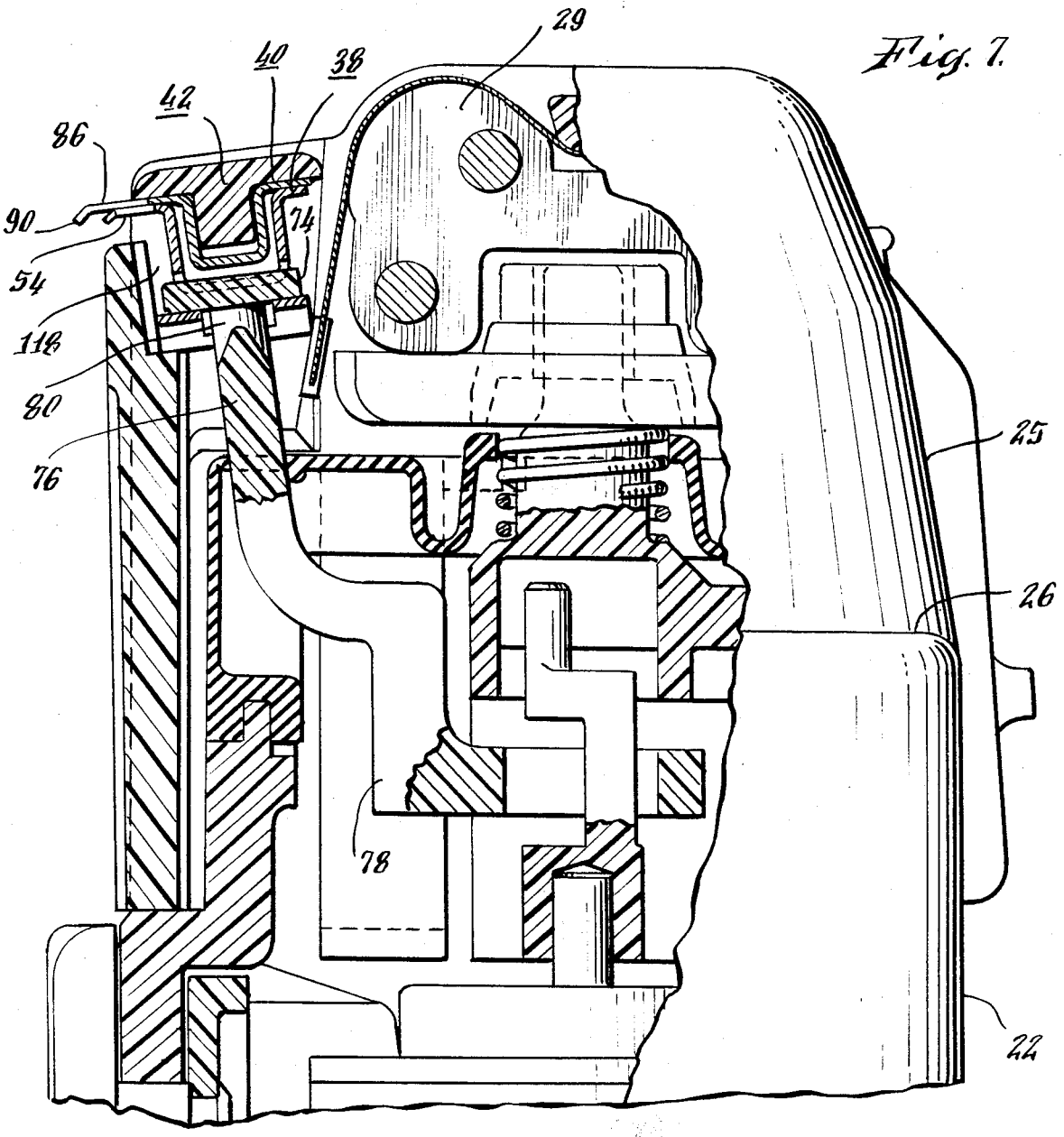
FIG. 7 is a view taken along Line 7—7 of FIG. 4.

The cover member 42 is formed of a polymer plastic and has a generally T-shaped cross sectional configuration, as best seen in FIGS. 6 & 7. Cover member 42 includes segments 92 and 94 having lower surfaces thereof which are juxtaposed with the comb member 40. An integral segment 96 depends from the cover member 42 and extends into the channel 84 of the comb member 40. Opposite ends 98 and 100 (FIG. 2) of the cover member 42 include integrally formed grooves 102 and 104 which engage ribs 106 and 108 which are integrally formed with the hair pocket 25. The cover member 42 also includes deformable bosses 110 and 112 which are positioned at the opposite ends 98 and 100, respectively. These bosses extend through apertures 114 and 116 (FIG. 4) in the hair pocket 25. Upon placement of the trimmer assembly into a recess 118 (FIG. 7) of the hair pocket, the bosses are deformed by the application of heat, by ultrasonic welding or by any other suitable process to deform and secure the assembly to the hair pocket.

The spring bias member 34 is a body formed of metal and includes an elongated slot 120 through which the depending legs 80 and 82 of the drive coupling number 36 extend. The elongated slot 120 is shaped and sized so as to enable the bias member 34 to extend about a part of the drive coupling member 36 and to contact a lower surface of the drive coupling member 36 and establish a force thereon which maintains sliding engagement between the teeth 56 of the cutter member 38 and teeth 88 of the comb member 40. Segment 121 extends laterally from the member 34 and presents more contact area to the drive segment 74 than a rearward segment 119 of bias member 34 and causes the application of an increased force to a forward part 123 of drive body segment 74 relative to that applied by the rear segment 119 of the bias member 34. This results in the application of a greater force being applied between the comb and cutter segments 86 and 54, respectively than is applied between rear segments 125 and 127, respectively of these members. The spring bias member 34 includes slots 124 and 126 formed therein which engage studs 130 and 132 respectively (FIG. 4) which are integrally formed in the hair pocket 25.

An improved electric dry shaver has thus been described which includes a compact trimmer arrangement which facilitates fabrication and assembly thereof. The arrangement thus described provides a trimmer which is relatively rigid and wherein the cutter member can be lapped with facility. Because of the nesting of the comb and cutter members, the fabrication and dimensioning of these members is also facilitated. Each of these members fits on the trimmer housing in the same manner and the assembly is thereof enhanced.

While there has been described a particular embodiment of the invention, it will be apparent to those skilled in the art that variations may be made thereto without departing from the spirit of the invention and the scope of the appended claims.

What is claimed is:

1. An improved electric dry shaver comprising:

a. A hand-held housing having an end thereof;

b. A cutter head including a hair pocket mounted at said end of said housing;

c. Said hair pocket including a short hair cutter member and a hair trimmer assembly;

d. Said hair pocket including an elongated recess integrally formed therein for receiving said trimmer assembly;

e. Said trimmer assembly positioned in said elongated recess;

f. Said hair trimmer assembly including:

(1) An elongated comb member having a generally U-shaped cross sectional configuration and an elongated edge segment having a plurality of teeth formed therein, said U-shaped cross sectional configuration defining an elongated comb channel;

(2) An elongated cutter member having a generally U-shaped cross sectional configuration and an elongated edge segment having a plurality of teeth formed therein, said U-shaped cross sectional configuration defining an elongated cutter channel;

(3) Said comb channel nested in said cutter channel along the length of said comb;

(4) Said comb and cutter teeth juxtapositioned for sliding engagement between surfaces thereof;

(5) A spring bias member for maintaining said comb and cutter teeth surfaces in sliding engagement;

(6) Means for mounting said comb and trimmer members to said hairpocket in said recess, said means comprising an elongated cover member extending substantially co-extensively in length with said comb member, said cover member including means for engaging said hair pocket for mounting said assembly to said hair pocket; and, g. Means for imparting reciprocating motion of said trimmer cutter member.

2. The improved electric dry shaver of claim 1 wherein said cover member includes first and second opposite ends thereof and means are formed at said first and second opposite ends for engaging said hair pocket and mounting said trimmer assembly thereto.

3. The improved electric dry shaver of claim 2 wherein said hair pocket engaging means includes grooves formed at opposite ends of said cover member and ribs integrally formed in said hair pocket for engaging said grooves, and deformable means formed in said cover member for engaging said hair pocket for mounting said trimmer assembly to said hair pocket.

4. The improved electric dry shaver of claim 3 wherein said deformable means comprises a first integrally formed, deformable boss positioned adjacent said first end of said cover member and a second integrally formed, deformable boss positioned adjacent said second end of said cover member, first and second apertures formed in said hair pocket, and said bosses are positioned for extending through said hair pocket apertures, said bosses having distal end segments thereof whereby upon deformation of said distal end segments, said trimmer assembly is captivated in said hair pocket recess.

5. The improved electric dry shaver of claim 4 wherein said trimmer assembly includes a drive member for engaging said cutter member for imparting mechanical motion to said cutter member and said spring biasing member is positioned between said drive member and a surface of said hair pocket for maintaining said edge segments of said comb and blade members in sliding engagement.

6. The improved electric dry shaver of claim 5 wherein said spring biasing member comprises an elongated, generally planar-shaped, resilient body having first and second slots formed therein at opposite ends thereof and said hair pocket includes first and second integrally formed studs positioned in said hair pocket for engaging said slots for maintaining said spring in predetermined orientation on said hair pocket.

7. The improved electric dry shaver of claim 5 wherein said drive member includes first and second integrally formed post segments thereof, said cutter member includes first and second apertures formed in a surface thereof and said post segments extend through said apertures in said cutter member and maintain engagement therebetween.

8. The improved electric dry shaver of claim 1 wherein said comb member edge segment extends laterally beyond the juxtaposed edge segment of said cutter member.

9. The improved electric dry shaver of claim 8 wherein said cover member includes a surface thereof which is positioned in juxtaposed relationship with a surface of said comb member.

10. The improved electric dry shaver of claim 1 wherein said comb and cutter members have juxtaposed surfaces thereof which are positioned in sliding engagement and said spring bias member establishes a force therebetween for maintaining said sliding engagement and is adapted to establish a greater bias force between juxtaposed surfaces of said comb and cutter teeth segments which are in sliding engagement than a force which is established between remaining juxtaposed surfaces of said comb and cutter member which are in sliding engagement.

* * * * *